US010982674B2

(12) United States Patent
Kim

(10) Patent No.: US 10,982,674 B2
(45) Date of Patent: Apr. 20, 2021

(54) SCROLL COMPRESSOR WITH BACK PRESSURE CHAMBER AND BACK PRESSURE PASSAGES

(71) Applicant: LG ELECTRONICS INC., Seoul (KR)

(72) Inventor: Minjae Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 189 days.

(21) Appl. No.: 16/292,742

(22) Filed: Mar. 5, 2019

(65) Prior Publication Data

US 2020/0088197 A1 Mar. 19, 2020

(30) Foreign Application Priority Data

Sep. 19, 2018 (KR) ..... 10-2018-0112427

(51) Int. Cl.
*F04C 28/06* (2006.01)
*F04C 28/26* (2006.01)
(Continued)

(52) U.S. Cl.
CPC ..... *F04C 29/0028* (2013.01); *F04C 18/0215* (2013.01); *F04C 29/068* (2013.01);
(Continued)

(58) Field of Classification Search
CPC ..... F04C 29/0028; F04C 18/0215; F04C 29/068; F04C 29/12; F04C 28/26;
(Continued)

(56) References Cited

U.S. PATENT DOCUMENTS 5,640,854 A * 6/1997 Fogt ..... F01C 1/0215 62/197
6,095,765 A * 8/2000 Khalifa ..... F04C 28/28 417/310

(Continued)

FOREIGN PATENT DOCUMENTS

KR 10-2017-0135193 12/2017
KR 10-2018-0069578 6/2018

(Continued)

OTHER PUBLICATIONS

Korean Notice of Allowance dated Jan. 15, 2020.
Korean Office Action dated Oct. 25, 2019.

*Primary Examiner* — Deming Wan
(74) *Attorney, Agent, or Firm* — KED & Associates LLP

(57) ABSTRACT

A scroll compressor may include an orbiting scroll; a non-orbiting scroll engaged with the orbiting scroll to form a pair of compression chambers between the orbiting scroll and the non-orbiting scroll; a back pressure chamber assembly coupled to the non-orbiting scroll to form a back pressure chamber to support the non-orbiting scroll toward the orbiting scroll; a first back pressure passage that connects a first intermediate pressure chamber in the compression chamber and the back pressure chamber; a second back pressure passage that connects a second intermediate pressure chamber having a higher pressure than the first intermediate pressure chamber and the back pressure chamber; and a back pressure control valve configured to selectively open and close the first back pressure passage and the second back pressure passage according to an operation mode. The back pressure control valve moves to a first position at which the first back pressure passage is open and the second back pressure passage is closed in a power operation, and moves to a second position at which the first back pressure passage
(Continued)

is closed and the second back pressure passage is open in a saving operation.

18 Claims, 12 Drawing Sheets

(51) Int. Cl.

| | |
|---|---|
| ***F04C 18/02*** | (2006.01) |
| ***F04C 29/00*** | (2006.01) |
| ***F04C 29/06*** | (2006.01) |
| ***F04C 29/12*** | (2006.01) |
| ***F04C 28/16*** | (2006.01) |
| ***F04C 28/18*** | (2006.01) |
| ***F04C 28/24*** | (2006.01) |
| ***F04C 23/00*** | (2006.01) |

(52) U.S. Cl.
CPC ..... *F04C 29/12* (2013.01); *F04C 2240/30* (2013.01); *F04C 2270/135* (2013.01); *F04C 2270/185* (2013.01)

(58) Field of Classification Search
CPC ..... F04C 18/0261; F04C 28/16; F04C 28/18; F04C 28/24; F04C 18/0253; F04C 18/0246; F04C 29/128; F04C 23/008; F04C 27/005; F04C 28/265; F04C 28/06
USPC ..... 418/55.1–55.6
See application file for complete search history.

(56) References Cited

U.S. PATENT DOCUMENTS

| | | | | |
|---|---|---|---|---|
| 6,164,940 | A * | 12/2000 | Terauchi | F04C 28/12 418/14 |
| 9,127,677 | B2 * | 9/2015 | Doepker | F04C 28/16 |
| 2004/0265140 | A1 * | 12/2004 | Sun | F04C 18/0215 417/310 |
| 2009/0208348 | A1 * | 8/2009 | Kiem | F04C 18/0215 417/213 |

FOREIGN PATENT DOCUMENTS

| | | |
|---|---|---|
| KR | 10-2018-0080007 | 7/2018 |
| KR | 10-2018-0089774 | 8/2018 |

* cited by examiner

SCROLL COMPRESSOR WITH BACK PRESSURE CHAMBER AND BACK PRESSURE PASSAGES

CROSS-REFERENCE TO RELATED APPLICATION(S)

This application claims priority under 35 U.S.C. § 119 to Korean Application No. 10-2018-0112427, filed in Korea on Sep. 19, 2018, whose entire disclosure is hereby incorporated by reference in its entirety.

BACKGROUND

1. Field

A scroll compressor is disclosed herein.

2. Background

A scroll compressor includes a non-orbiting scroll and an orbiting scroll engaged with each other in an inner space of a casing. The orbiting scroll is coupled to and performs an orbiting movement with respect to the non-orbiting scroll. A pair of compression chambers each including a suction chamber, an intermediate pressure chamber, and a discharge chamber are formed between a non-orbiting wrap of the non-orbiting scroll and an orbiting scroll of the orbiting scroll.

The scroll compressor is characterized in that suction, compression, and discharge strokes of refrigerant are smoothly carried out while obtaining a relatively high compression ratio as compared with other types of compressors. Accordingly, the scroll compressor is widely used for refrigerant compression in an air conditioner, for example, because of its advantage of obtaining stable torque.

In the scroll compressor, when a specification of the non-orbiting wrap and the orbiting wrap is determined, a suction volume and a discharge volume thereof are determined, and a compression ratio of the relevant compressor is determined. Then, the compressor compresses refrigerant according to the determined compression ratio.

In recent years, a so-called "modulation scroll compressor" has been introduced in which the compression ratio is adjusted according to an operation mode. For example, all of a refrigerant is compressed and discharged to a discharge port in a power mode while a portion of the refrigerant to be compressed is bypassed prior to the discharge port in a saving mode to lower the compression ratio.

In terms of load in a refrigeration cycle device, a modulation scroll compressor as described above is advantageous as a variable ratio of the compression capacity (hereinafter, "cooling capacity") is lower, that is, as a compression capacity in a partial load operation (hereinafter, "saving operation") is lower than a compression capacity in a power operation, when the compression capacity of a full load operation (hereinafter, "power operation") is 100%. For this purpose, it is advantageous in terms of power consumption in an air conditioning system as a capacity variable bypass hole (hereinafter, abbreviated as "bypass hole") being located close to a discharge port can increase a variable amount of capacity between the power operation and the saving operation.

However, a modulation scroll compressor according to the related art as described above has a problem in that it is difficult to properly adjust pressure in a back pressure chamber in accordance with the operation mode of the compressor as the pressure of the back pressure chamber is adjusted using one intermediate pressure. In other words, when the bypass hole moves toward the discharge port, the back pressure hole also moves toward the discharge port. However, when locations of the bypass hole and the back pressure hole are set based on the saving operation, the bypass hole and the back pressure hole move close to the discharge port. As the back pressure hole moves closer to the discharge port, the back pressure may increase, and thus, in the power operation, the back pressure may be excessively higher than a proper pressure, thereby causing reliability deterioration while increasing friction loss between the non-orbiting scroll and the orbiting scroll. In contrast, when the location of the back pressure hole is set based on the power operation, the bypass hole and the back pressure hole move away from the discharge port. As the back pressure hole moves away from the discharge port and closer to the suction port, the back pressure may decrease, and thus, the discharge pressure may be reduced in the saving operation and a clearance may be generated between the non-orbiting scroll and the orbiting scroll while the orbiting scroll is tilted, thereby generating noise or leaking refrigerant.

Further, in the modulation scroll compressor according to the related art, structure for bypassing a portion of refrigerant compressed in the compression chamber may be complicated, thereby causing a problem of increasing manufacturing costs. In addition, in the modulation scroll compressor according to the related art, when a portion of the capacity variable device is provided outside of the casing, a number of parts or components for connecting the capacity variable device and a number of assembly processes may increase, thereby increasing manufacturing costs as well as causing difficulties in sealing at a connecting portion during assembly.

BRIEF DESCRIPTION OF THE DRAWINGS

Embodiments will be described in detail with reference to the following drawings in which like reference numerals refer to like elements, and wherein:

FIGS. 10A and 10B are views showing a power operation, and FIGS. 11A and 11B are views showing a saving operation.

DETAILED DESCRIPTION

Figure 1:
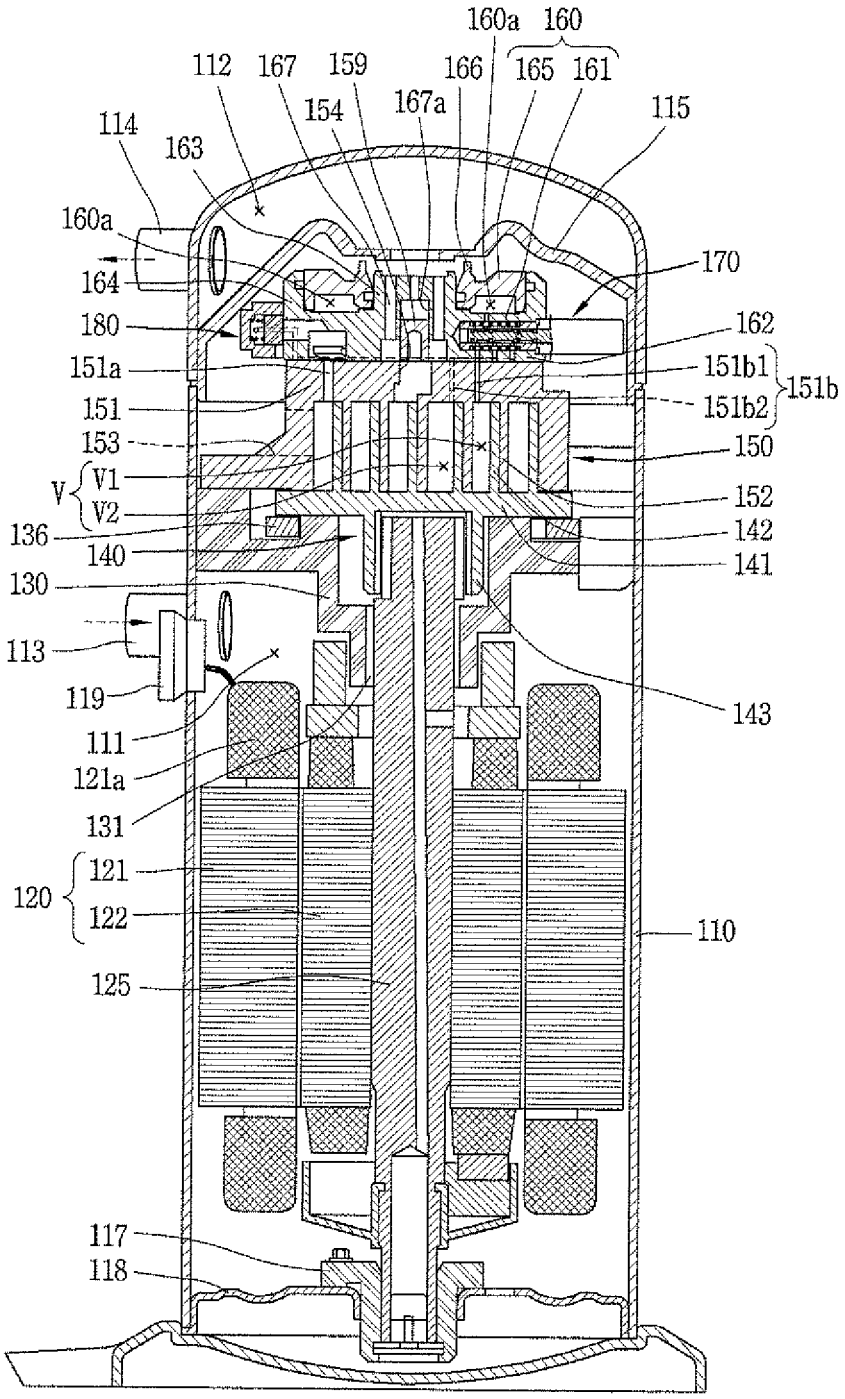
FIG. 1 is a longitudinal cross-sectional view showing a scroll compressor having a capacity variable device according to an embodiment.

Hereinafter, a scroll compressor according to an embodiment will be described with reference to an embodiment illustrated in the accompanying drawings. Wherever possible, like reference numerals have been used to indicate like elements and repetitive disclosure has been omitted.

FIG. 1 is a longitudinal cross-sectional view showing a scroll compressor having a capacity variable device according to an embodiment. Referring to FIG. 1, in a scroll compressor according to an embodiment, a sealed internal space of a casing 110 may be divided into a suction space 111 which is a low pressure portion and a discharge space 112 which is a high pressure portion by a high-low pressure separation plate 115. The suction space 111 may correspond to a lower space of the high-low pressure separation plate 115, and the discharge space 112 may correspond to an upper space of the high-low pressure separation plate 115.

A suction pipe 113 that communicates with the suction space 111 and a discharge pipe 114 that communicates with the discharge space 112 may be respectively fixed to the casing 110. Accordingly, refrigerant may be suctioned into the internal space of the casing 110 through the suction pipe 113, and discharged to an outside of the casing 110 through the discharge pipe 114.

A drive motor 120 having a stator 121 and a rotor 122 may be provided in the suction space 111 of the casing 110. The stator 121 may be fixed to an inner wall surface of the casing 110 in a heat shrinking manner, for example, and a rotational shaft 125 may be inserted and coupled to a central portion of the rotor 122. A coil 121*a* may be wound around the stator 121, and the coil 121*a* may be electrically connected to an external power source through a terminal 119 which may penetrate and be coupled to the casing 110.

A lower side of the rotational shaft 125 may be rotatably supported by an auxiliary bearing 117 provided below the casing 110. The auxiliary bearing 117 may be supported by a lower frame 118 fixed to the inner wall surface of the casing 110 to stably support the rotational shaft 125. The lower frame 118 may be, for example, welded and fixed to the inner wall surface of the casing 110, and a bottom surface of the casing 110 may be used as an oil storage space. Oil stored in the oil storage space may be transferred to an upper side by the rotational shaft 125, for example, and the oil may enter a drive unit and a compression chamber to facilitate lubrication.

An upper end portion or end of the rotational shaft 125 may be rotatably supported by a main frame 130, The main frame 130 may be fixed and installed on the inner wall surface of the casing 110 like the lower frame 118, a downwardly protruding main bearing portion or bearing 131 may be formed on a lower surface thereof, and the rotational shaft 125 may be inserted into the main bearing 131. An inner wall surface of the main bearing 131 may function as a bearing surface and support the rotational shaft 125 together with the above-described oil so as to smoothly rotate.

An orbiting scroll 140 may be disposed on an upper surface of the main frame 130. The orbiting scroll 140 may include an orbiting end plate portion or end plate 141 having a substantially disk shape and an orbiting wrap 142 formed in a spiral shape on one side surface of the orbiting end plate 141. The orbiting wrap 142 may form a compression chamber (V) together with a non-orbiting wrap 152 of a non-orbiting scroll 150, which will be described hereinafter.

The orbiting end plate 141 may be orbitably driven while being supported by the upper surface of the main frame 130. An oldham ring 136 may be provided between the orbiting end plate 141 and the main frame 130 to prevent rotation of the orbiting scroll 140.

A boss portion or boss 143 to which the rotational shaft 125 may be inserted and coupled may be formed on a bottom surface of the orbiting end plate 141. As a result, the orbiting scroll 140 may be orbitably driven by a rotational force of the rotational shaft 125.

The non-orbiting scroll 150 engaged and coupled to the orbiting scroll 140 may be disposed at an upper portion of the orbiting scroll 140. The non-orbiting scroll 150 may be movable up and down with respect to the orbiting scroll 140, and more specifically, a plurality of guide pins (not shown) inserted into the main frame 130 may be placed and supported on the upper surface of the main frame 130 in a state of being inserted into a plurality of guide holes (not shown) formed on an outer circumferential portion of the non-orbiting scroll 150.

A non-orbiting end plate portion or end plate 151 may be formed in a disk shape, and the non-orbiting scroll 152 may be engaged with the orbiting wrap 142 to form a pair of compression chambers formed in a spiral shape at a lower portion of a non-orbiting end plate 151.

A suction port 153 that suctions refrigerant existing within the suction space 111 may be formed on or at a side surface of the non-orbiting end plate 151, and a discharge port 154 that discharges the compressed refrigerant may be formed in a substantially central portion of the non-orbiting end plate 151.

A scroll side bypass hole 151*a* and a scroll side back pressure hole 151*b* may be formed between the suction port 153 and the discharge port 154 with respect to a compression path. The scroll side back pressure hole 151*b* may be formed at a position further moved toward the discharge port 154 than the scroll side bypass hole 151*a*, which will be described hereinafter together with a capacity variable unit.

The orbiting wrap 142 and the non-orbiting wrap 152 form a plurality of compression chambers (V), and the compression chambers may be orbitably moved to a side of the discharge port 154 while reducing a volume to compress refrigerant. Therefore, a pressure of the compression chamber adjacent to the suction port 153 may be minimized, a pressure of the compression chamber communicating with the discharge port 154 may be maximized, and a pressure of the compression chamber existing therebetween forms an intermediate pressure having a value between a suction pressure of the suction port 153 and a discharge pressure of the discharge port 154. Therefore, the scroll side bypass hole 151*a* and the scroll side back pressure hole 151*b* may communicate with intermediate pressure chambers (V1, V2), and the scroll side back pressure hole 151*b* may communicate with an intermediate pressure chamber higher than the scroll side bypass hole 151*a*.

The scroll side back pressure hole 151*b* may include a first intermediate pressure hole 151*b*1 and a second intermediate pressure hole 151*b*2. The first intermediate pressure hole 151*b*1 and the second intermediate pressure hole 151*b*2 may communicate with the intermediate pressure chambers (V1, V2) having different intermediate pressures. That is, the first intermediate pressure hole 151*b*1 may communicate with an intermediate pressure chamber having a relatively lower intermediate pressure than the second intermediate pressure hole 151*b*2.

A back pressure chamber assembly 160 may be coupled to an upper surface of the non-orbiting scroll 150. The back pressure chamber assembly 160 may include a back pressure plate 161 and a floating plate 165.

The back pressure plate 161 may be formed in a substantially annular shape, and may be provided with a support plate portion or plate 162 brought into contact with the non-orbiting plate 151. The support plate 162 may be formed in an annular plate shape with an empty or hollow center.

A first annular wall 163 and a second annular wall 164 may be formed at a preset or predetermined interval in a radial direction on an upper surface of the support plate 162 at inner and outer circumferential surfaces of the support plate 162. Accordingly, an outer circumferential surface of the first annular wall 163, an inner circumferential surface of the second annular wall 164, and an upper surface of the support plate 162 may form an annular back pressure chamber 160*a*.

The support plate 162 between the first annular wall 163 and the second annular wall 164 may be provided with a plurality of plate side back pressure holes (hereafter, "a first back pressure hole" and a "second back pressure hole" 161*e*1, 161*e*2) that independently communicate with a first intermediate pressure hole 151*a*1 and a second intermediate bore hole 151*a*2, respectively, which may pass through the support plate 162 in an axial direction. A suction pressure hole 161*e*4 and mode switching holes 161*e*5, 161*e*6 that provide selective communication between the suction space 111 of the casing 110 and a differential pressure space 181*b* of a capacity control valve 180 may be formed at an outside of a second back pressure hole 161*e*2. These holes will be described hereinafter with the capacity variable unit.

An intermediate discharge port 167 that communicates with the discharge port 154 may be formed on an inner side of the first annular wall 163. A plurality of intermediate discharge ports 167 may be formed along a circumferential direction. A valve guide portion or guide 167*a* may be formed on or at an inner side of the intermediate discharge port 167, and a check valve 159 that opens and closes the discharge port 154 may be slidably inserted into the valve guide 167*a*.

The floating plate 165 may be slidably inserted between the first annular wall 163 and the second annular wall 164. Accordingly, the floating plate 165 may form an upper surface of the back pressure chamber 160*a*. A sealing end portion or end 166 may be provided at an upper end portion or end of an inner space portion or space of the floating plate 165. The sealing end 166 may protrude upward from a surface of the floating plate 165, and an inner diameter thereof may be formed to such an extent that it does not cover the intermediate discharge port 167. The sealing end 166 may contact a lower surface of the high-low pressure separation plate 115 to perform a role of sealing discharged refrigerant to be discharged into the discharge space 112 without leaking into the suction space 111.

A scroll compressor according to the above-discussed embodiment may operate as follows.

When power is applied to the stator 121, the rotational shaft 125 may rotate together with the rotor 122. Then, the orbiting scroll 140 coupled to an upper end of the rotational shaft 125 may perform an orbiting movement with respect to the non-orbiting scroll 150, and a pair of compression chambers (V) may be formed between the orbiting wrap 142 and the non-orbiting wrap 152. The pair of compression chambers (V) may be reduced in volume while moving from the outside to the inside, thereby suctioning, compressing, and discharging refrigerant.

A portion of refrigerant moving along a trajectory of the compression chamber (V) may move to the back pressure chamber 160*a* from the first intermediate pressure chamber (V1) or the second intermediate pressure chamber (V2) through a first back pressure passage (BF1) or a second back pressure passage (BF2), which will be described hereinafter, prior to reaching the discharge port 154. Accordingly, the back pressure chamber 160*a* may form the back pressure of the first intermediate pressure or the second intermediate pressure.

Due to the back pressure of the back pressure chamber 160*a*, the floating plate 165 may be brought into close contact with the high-low pressure separation plate 115 while receiving upward pressure, and the discharge space 112 and the suction space 111 of the casing 110 may be separated from each other to prevent refrigerant discharged to the discharge space 112 from leaking to the suction space 111. In contrast, the back pressure plate 161 may receive downward pressure by the back pressure of the back pressure chamber 160*a* to press the non-orbiting scroll 150 in an orbiting scroll direction. Then, the non-orbiting scroll 150 may be brought into close contact with the orbiting scroll 140 to block refrigerant compressed in the compression chamber (V) from leaking between the orbiting scroll 140 and the non-orbiting scroll 150. As a result, a series of processes of allowing refrigerant suctioned into the suction space 111 of the casing 110 to be compressed in the compression chamber (V) and discharged to the discharge space 112, and allowing refrigerant discharged to the discharge space 112 to be circulated in the refrigeration cycle, and then suctioned again into the suctioned space 111 may be repeated.

The scroll compressor according to embodiments may be provided with a capacity variable device capable of performing a full load operation (hereinafter, "power operation") or a partial load operation (hereinafter, "saving operation") according to a need of a cooling system to which the compressor is applied. For example, the capacity variable device may form a bypass passage in a middle of the compression chamber, thereby reducing compression capacity by shortening a period in which a substantial compression chamber is formed in the saving operation.

However, when the operation mode of the scroll compressor changes, a discharge pressure required for sealing both scrolls is changed. In other words, as described above, a relatively low back pressure is required in the power operation and a relatively high back pressure is required in the saving operation. Accordingly, when the back pressure of the back pressure chamber is the same regardless of the operation mode of the compressor, over-pressure may occur in the power operation, and under-pressure may occur in the saving mode. As a result, in embodiments disclosed herein, a capacity variable device capable of varying discharge pressure according to the operation mode is presented.

Figure 2:
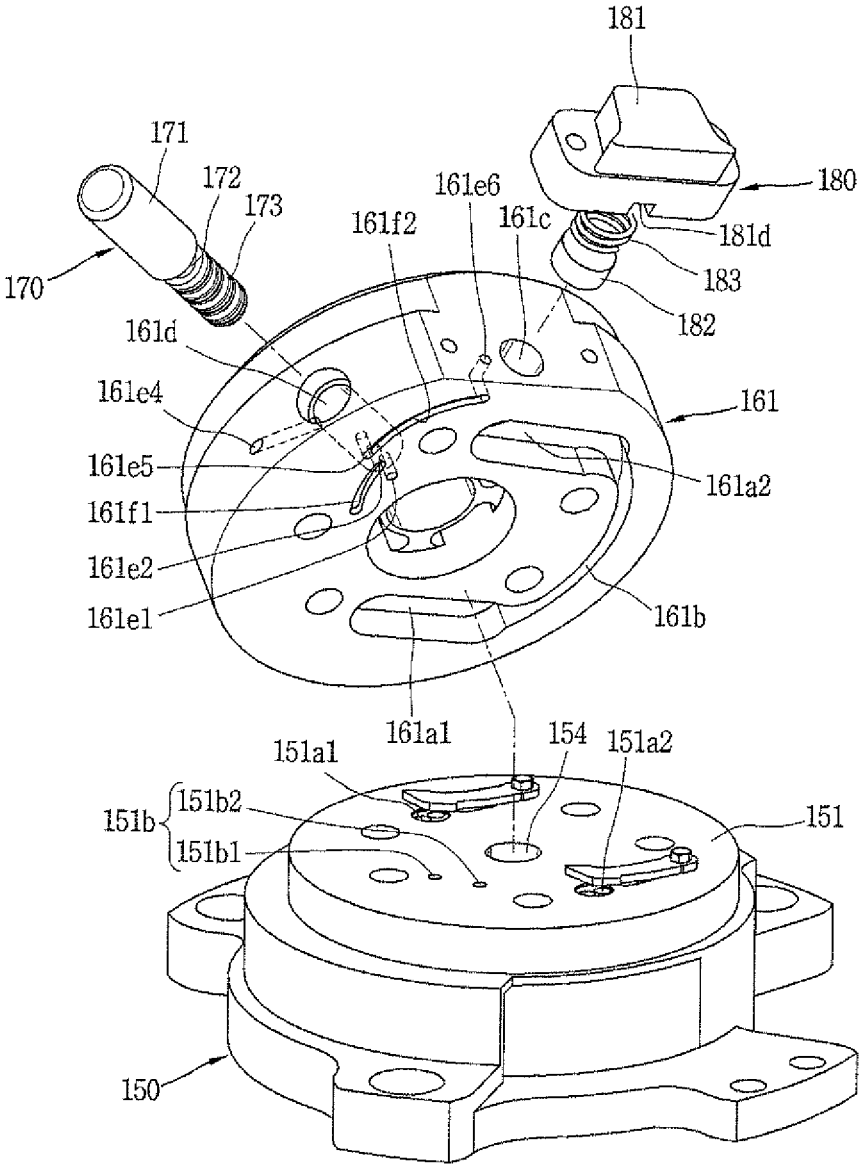
FIG. 2 is an exploded perspective view showing a capacity variable device according to an embodiment.
Figure 3:
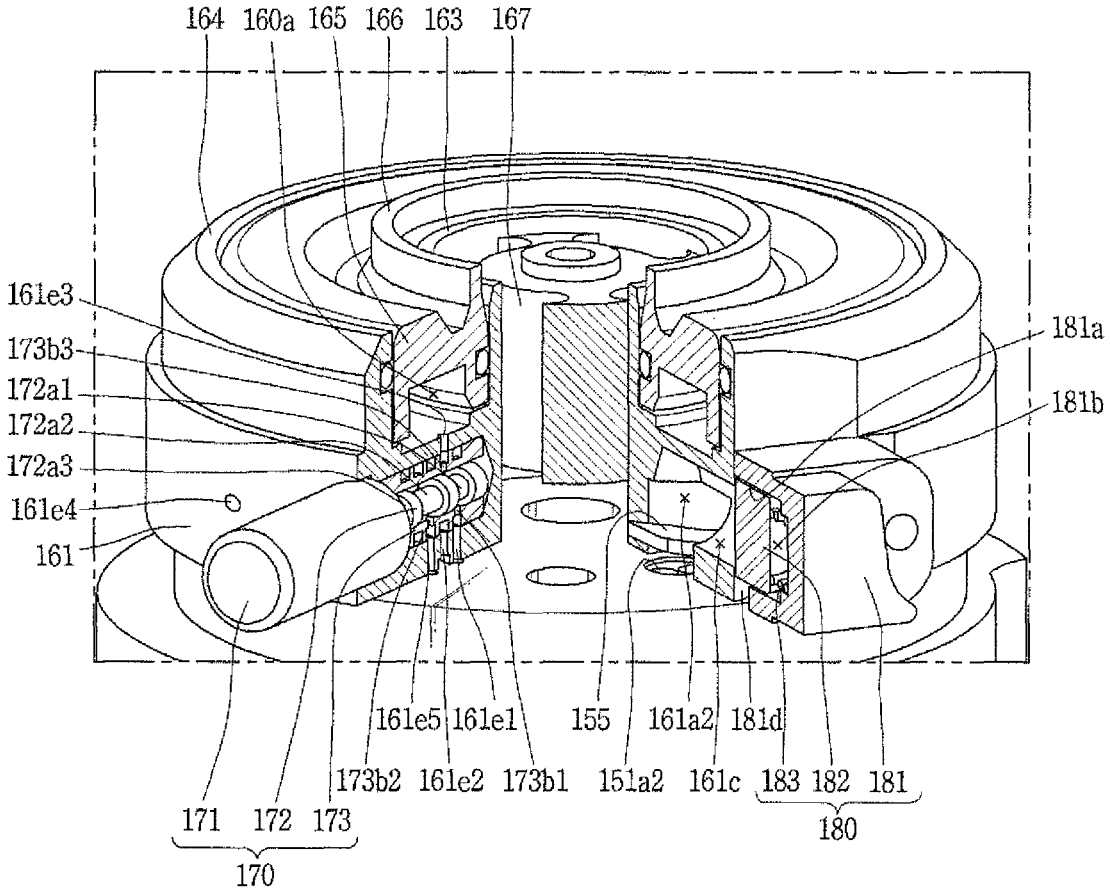
FIG. 3 is an assembled perspective view showing the capacity variable device of FIG. 2.

FIG. 2 is an exploded perspective view showing a capacity variable device according to an embodiment. FIG. 3 is an assembled perspective view showing the capacity variable device in FIG. 2.

Referring to FIGS. 2 and 3, variable capacity bypass hole 151*b* capable of varying the operation mode of the compressor may be formed on the non-orbiting end plate 151 of the non-orbiting scroll 150. It may be referred to as a "capacity variable bypass hole". The capacity variable bypass hole 151*a* is an element for determining a cooling power ratio, and is usually formed at a position at which a cooling power ratio may be secured at about 60 to 70%. Of course, it is advantageous from a standpoint of the cooling system that the cooling power ratio may be controlled at 50% or less. However, it is difficult to secure stable discharge pressure when the cooling power ratio is lowered to 60% or less in a scroll compressor using a single back pressure.

However, in a case in which the capacity variable device capable of variable back pressure as in this embodiment is provided, the back pressure may be differently controlled according to the operation mode, and thus, a position of the capacity variable bypass hole 151*a* may be formed at a position at which the cooling power ratio is 50% or less. The capacity variable bypass hole according to this embodiment may communicate with the intermediate pressure chamber at a pressure lower than a pressure of a low pressure side back pressure passage (or first back pressure passage), which will be described hereinafter.

A plurality of capacity variable bypass holes (hereinafter, "bypass holes") 151*a*1, 151*a*2 may be provided, and the plurality of bypass holes 151*a*1, 151*a*2 may communicate with inner and outer pockets forming the same pressure, respectively. Therefore, the plurality of bypass holes 151*a*1, 151*a*2 may be formed on both sides approximately 180° apart. However, when the structure is asymmetric, that is, a wrap length of the orbiting wrap 142 is larger than a wrap length of the non-orbiting wrap 152 by approximately 180 degrees, the same pressure may be formed at a same crank angle in an inner pocket and an outer pocket, and thus, the plurality of bypass holes 151*a* may be formed at the same crank angle or only one second bypass hole 151*b* may be formed.

A check valve 155 may be provided on a back surface of the non-orbiting end plate 151 of the non-orbiting scroll 150 to open and close the bypass hole 151*a*. The check valve 155 may be a reed valve that is opened or close according to the pressure of the intermediate pressure chamber. Alternatively, the check valve may include a plurality of piston valves, according to circumstances.

A plurality of first valve receiving grooves 161*a*1, 161*a*2 recessed by a predetermined depth to accommodate the check valves 155 may be formed on a bottom surface of the back pressure plate 161 corresponding to a back surface of the non-orbiting end plate 151 of the non-orbiting scroll 150. The plurality of first valve receiving grooves 161*a*1, 161*a*2 may communicate with each other via an arc-shaped communication groove 161*b*. The communication groove 161*b* may be recessed a predetermined depth from a bottom surface of the back pressure plate 161 similarly to the first valve receiving groove 161*a*1.

The back pressure plate 161 may be formed with a discharge hole 161*c* that guides refrigerant bypassed through the bypass hole 151*a* to the suction space 111 of the casing 110. One or a first end of the discharge hole 161*c* may be connected to either one of the plurality of first valve receiving grooves 161*a*1, 161*a*1 or the communication groove 161*b*, and the other or a second end of the discharge hole 161*c* may pass through an outer circumferential surface of the back pressure plate 161. Accordingly, the first valve receiving groove 161*a*, the communication groove 161*b*, and the discharge hole 161*c* form a type of intermediate pressure space for accommodating intermediate pressure refrigerant when the check valve 155 is open.

The capacity control valve 180 provided on or at an end portion or end of the discharge hole 161*c* to selectively open and close the discharge hole 161*c* according to an operation mode of a cooling system so as to control an operation mode of the compressor may be provided on an outer circumferential surface of the back pressure plate 161. The capacity control valve 180 will be described hereinafter together with the back pressure control valve.

The first intermediate pressure hole 151*b*1 and the second intermediate pressure hole 151*b*2 forming scroll side back pressure holes may be formed in the non-orbiting end plate 151. The first intermediate pressure hole 151*b*1 and the second intermediate pressure hole 151*b*2 may be formed at positions spaced apart from each other by a predetermined interval along a path of the compression chamber. Accordingly, the first intermediate pressure hole 151*b*1 and the second intermediate pressure hole 151*b*2 may communicate with different intermediate pressure chambers (V1,V2).

The first intermediate pressure hole 151*b*1 may communicate with a first back pressure hole 161*e*1 of the back pressure plate 161 which will be described hereinafter to form the first back pressure passage (BF1), and the second intermediate pressure hole 151*b*2 may communicate with the second back pressure hole 161*e*2 of the back pressure plate 161 which will be described hereinafter to form the second back pressure passage (BF2). The first intermediate pressure hole 151*b*1 may communicate with an intermediate pressure chamber having a relatively low pressure compared to the second intermediate pressure hole 151*b*2. For example, the first intermediate pressure hole 151*b*1 may be formed at a back pressure hole position in a normal constant speed operation, and the second intermediate pressure hole 151*b*2 may be formed at a position communicating with an intermediate pressure chamber having a higher pressure than the back pressure hole position in a constant speed operation.

Figure 4:
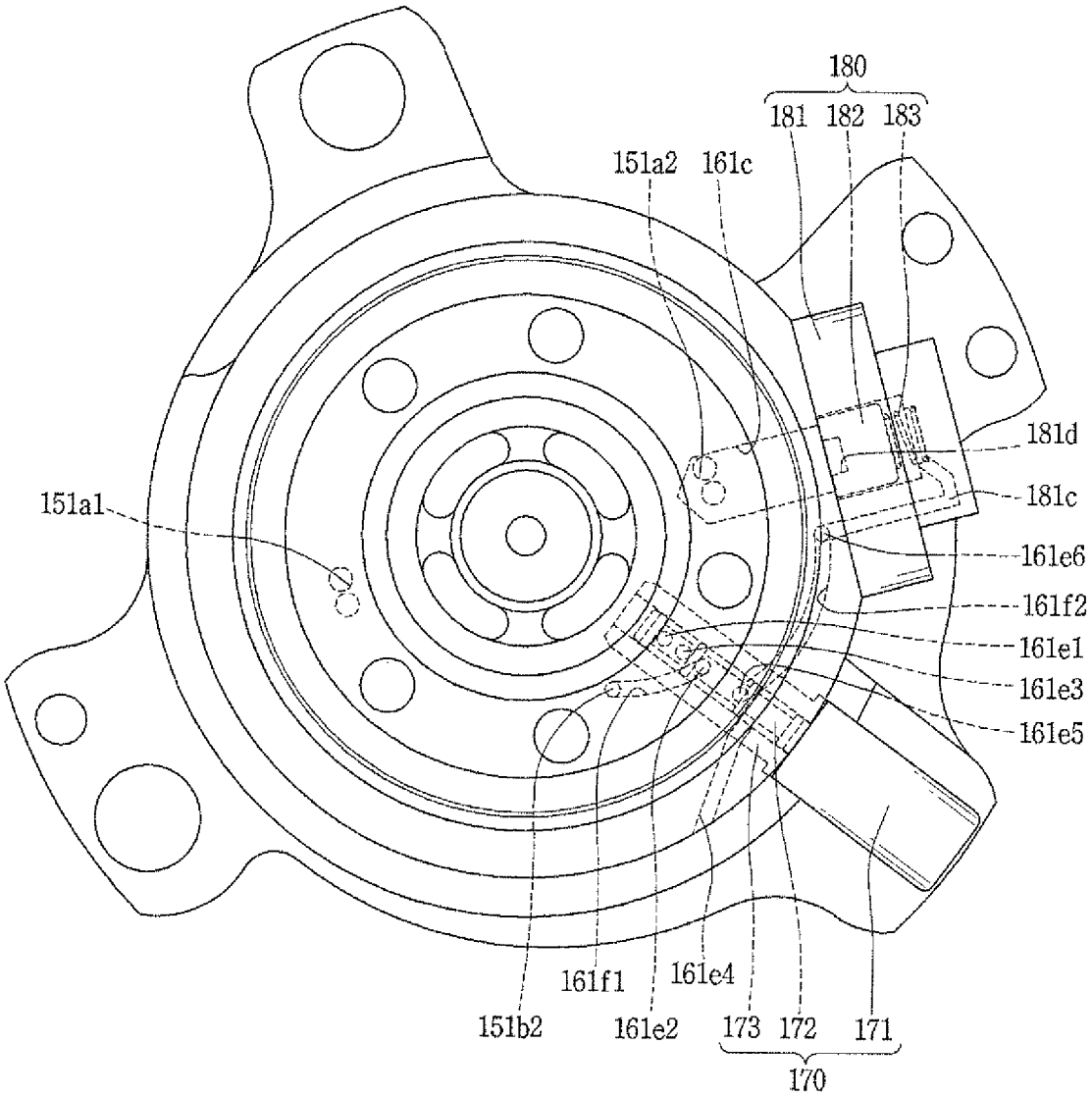
FIGS. 4 and 5 are a top plan view and a bottom view showing a back pressure plate provided with a variable capacity device according to an embodiment, respectively.
Figure 5:
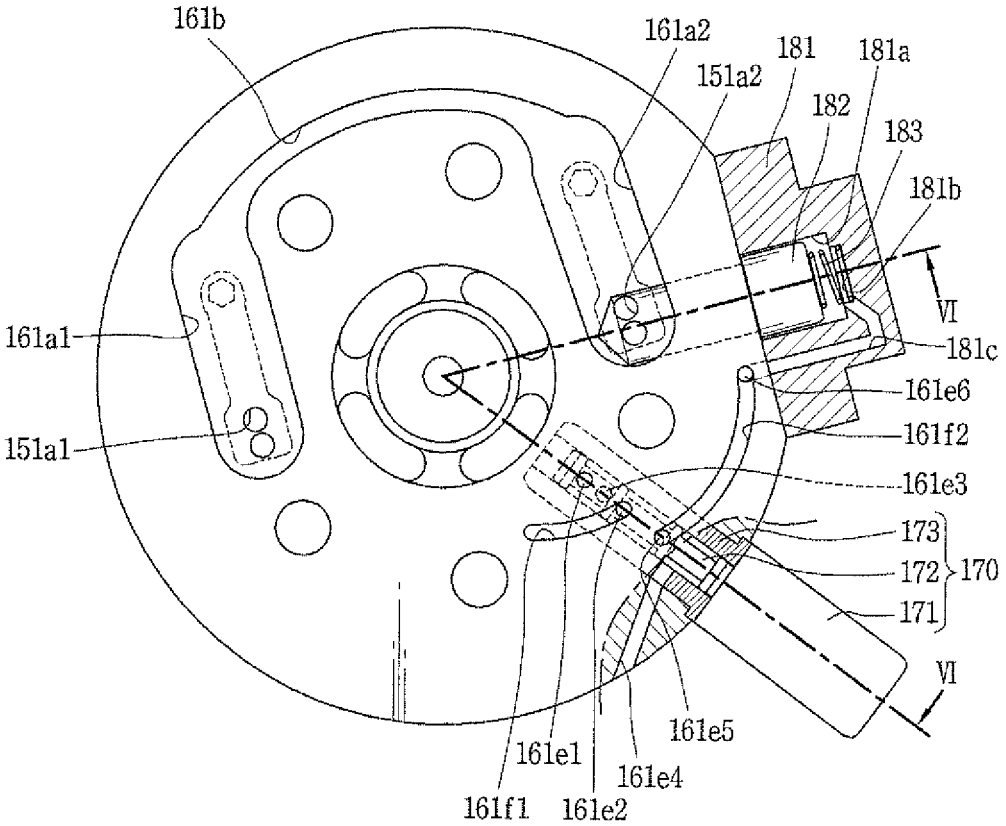
Figure 6:
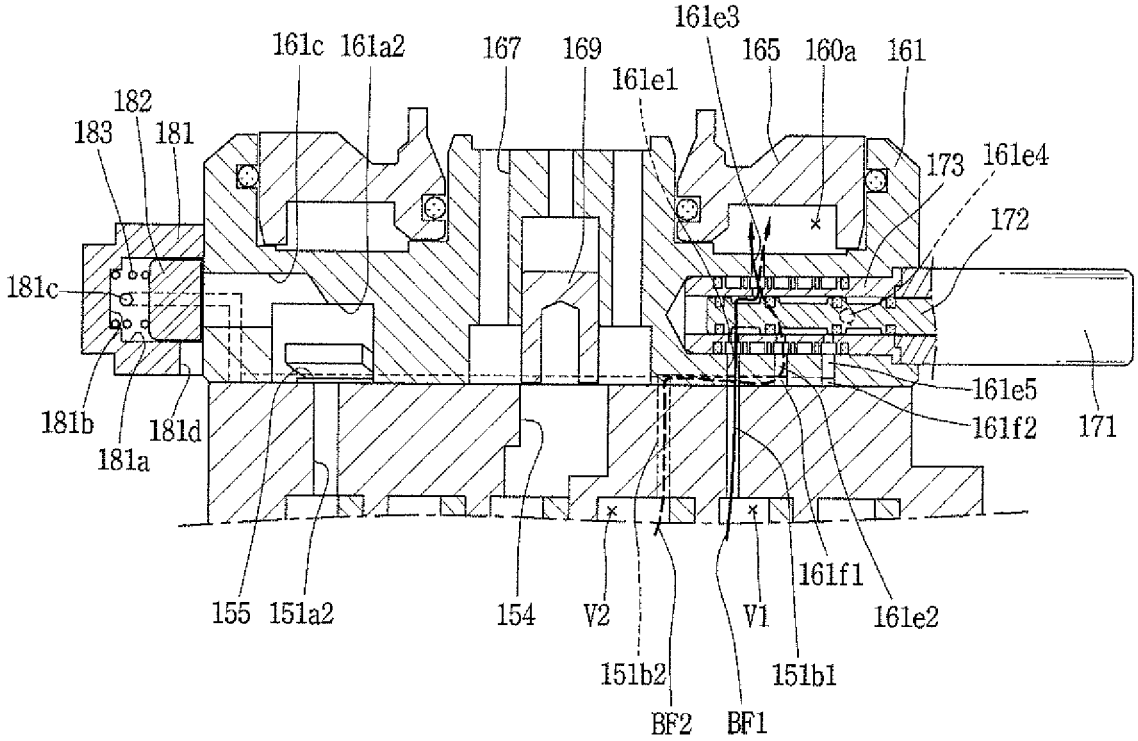
FIG. 6 is a cross-sectional view, taken along line "VI-VI" in FIG. 5.

FIGS. 4 and 5 are a top plan view and a bottom view showing a back pressure plate provided with a variable capacity device according to an embodiment, respectively. FIG. 6 is a cross-sectional view, taken along line "VI-VI" in FIG. 5.

Referring to FIGS. 4 through 6, a back pressure control valve 170 according to an embodiment is a valve that controls the pressure of the back pressure chamber 160*a* to vary according to the operation mode of the compressor (or cooling system). The back pressure control valve 170 may be provided in the back pressure plate 161. Alternatively, the back pressure control valve 170 may be provided in the non-orbiting scroll 150. However, in this embodiment, an example in which the back pressure plate is provided in the back pressure plate for convenience of explanation will be described.

A second valve receiving groove 161*d* may be formed in the back pressure plate 161 to receive and couple the back pressure control valve 170 thereto. The second valve receiving groove 161*d* may extend in a direction from an outer circumferential surface of the back pressure plate 161 toward the discharge port 154. The second valve receiving groove 161*d* may be formed in a circular cross-sectional shape having a preset or predetermined length and width as well as a long hole shape.

The second valve receiving groove 161*d* may communicate with the plurality of back pressure passages (BF1, BF2). The plurality of back pressure passages (BF1, BF2) may include a low pressure side back pressure passage (hereinafter, "first back pressure passage") (BF1) and a high pressure side back pressure passage (hereinafter, "second back pressure passage") (BF2). In some cases, the plurality of back pressure passages may include three or more back pressure passages. However, in this embodiment, a case in which there are two back pressure passages will be described as an example.

One or a first end of the first back pressure passage (BF1) may communicate with the first intermediate pressure chamber (V1), and one or a first end of the second back pressure passage (BF2) may communicate with the second intermediate pressure chamber (V2). The first intermediate pressure chamber (V1) may be an intermediate pressure chamber having a relatively lower pressure than a pressure of the second intermediate pressure chamber (V2). Therefore, the back pressure chamber 160*a* may form a low back pressure when the back pressure control valve 170 allows opening of the first intermediate pressure chamber (V1), and forms a high back pressure when the back pressure control valve 170 allows opening of the second intermediate pressure chamber (V2). The back pressure control valve 170 may be properly controlled according to the operation mode of the compressor.

The first back pressure passage (BF1) and the second back pressure passage (BF2) may be formed independently from inlets to outlets, respectively. However, in this embodiment, the inlet of the first back pressure passage (BF1) and the inlet of the second back pressure passage (BF2) are formed as individual inlets independent from each other, and the outlet of the first back pressure passage (BF1) and the outlet of the second back pressure passage (BF2) are made up of one common outlet. Through this, configuration of the valve may be simplified.

The first back pressure passage (BF1) may include a low pressure side back pressure hole (hereinafter, "first back pressure hole") 161*e*1 that communicates with one or first side of a bottom surface of the second valve receiving groove 161*d*, and a common side back pressure hole (hereinafter, "third back pressure hole") 161*e*3 that communicates with a center side of an upper surface of the second valve receiving groove 161*d*. The first back pressure hole 161*e*1 may communicate with the first intermediate pressure hole 151*b*1 provided in the non-orbiting end plate 151 of the non-orbiting scroll 150. The first back pressure hole 161*e*1 and the first intermediate pressure hole 151*b*1 of the non-orbiting scroll 150 may be formed on a straight line in an axial direction. However, in some cases, the first back pressure hole 161*e*1 and the first intermediate pressure hole 151*b*1 may be formed on an axial line with each other. In this case, the first back pressure hole 161*e*1 and the first intermediate pressure hole 151*b*1 of the non-orbiting scroll 150 may communicate via a connecting groove (not shown) that extends in a transverse direction. In other words, the first back pressure hole 161*e*1 and the first intermediate pressure hole 151*b*1 of the non-orbiting scroll 150 may communicate with each other even when they are formed at any position or different positions.

The third back pressure hole 161*e*3 may also communicate with the second back pressure hole 161*e*2 forming the second back pressure passage, and thus, the third back pressure hole 161*e*3 may be located between the first back pressure hole 161*e*1 and the second back pressure hole 161*e*2 in a radial direction. The third back pressure hole 161*e*3 will be described hereinafter together with the second back pressure hole 161*e*2.

The first back pressure passage (BF2) may include a high pressure side back pressure hole (hereinafter, "second back pressure hole") 161*e*2 that communicates with a center side of a bottom surface of the second valve receiving groove 161*d*, and the third back pressure hole 161*e*3 that communicates with a center side of an upper surface of the second valve receiving groove 161*d*. The third back pressure hole 161*e*3 may also form the first back pressure passage (BF1) as described above.

The second back pressure hole 161*e*2 may communicate with the second intermediate pressure hole 151*b*2 provided in the non-orbiting end plate 151. The second back pressure hole 161*e*2 and the second intermediate pressure hole 151*b*2 of the non-orbiting scroll 150 may be formed on different lines in an axial direction. For example, the second back pressure hole 161*e*2 must be formed inward with respect to a forming path of the compression chamber so as to be closer to the discharge chamber (or discharge port) than the first back pressure hole 161*e*1. However, as the back pressure control valve 170 which will be described hereinafter is linearly formed and radially coupled thereto, the second back pressure hole 161*e*2 may be radially located on a straight line with the first back pressure hole 161*e*1 as much as possible. Therefore, the second back pressure hole 161*e*2 may be located on a straight line with the first back pressure hole 161*e*1, but the first extension groove 161*f*1 provides communication between the second back pressure hole 161*e*2 and the second intermediate pressure hole 151*b*2 of the non-orbiting scroll 150 is formed to be long in a transverse direction.

Of course, in some cases, the second back pressure hole 161*e*2 and the second intermediate pressure hole 151*b*2 may be formed on the same axial line, and the second back pressure hole 161*e*2 and the first intermediate pressure hole 151*b*1 may communicate via a connecting groove extending in a transverse direction. In other words, the second back pressure hole 161*e*2 and the second intermediate pressure hole 151*b*2 may communicate with each other when they are formed at any position or different positions.

The third back pressure hole 161*e*3 may be formed on or at a center side of an upper surface of the second valve receiving groove 161*d*. The third back pressure hole 161*e*3 must communicate with the first back pressure hole 161*e*1 or the second back pressure hole 161*e*2 according to the operation mode of the compressor, and thus, may be located between the first back pressure hole 161*e*1 and the second back pressure hole 161*e*1 with respect to a radial direction.

One or a first end of the third back pressure hole 161*e*3 may communicate with the second valve receiving groove 161*d*, and the other or a second end thereof may communicate with the back pressure chamber 160*a*. Accordingly, the first intermediate pressure chamber (V1) may communicate with the back pressure chamber 160*a* through the first back pressure hole 161*e*1 and the third back pressure hole 161*e*3 or the second intermediate pressure chamber (V2) may communicate with the back pressure chamber 160*a* through the second back pressure hole 161*e*2 and the third back pressure hole 161*e*3. On the other hand, the second valve accommodating groove 161*d* may communicate with the suction pressure hole 161*e*4 and the first mode switching hole 161*e*5. The suction pressure hole 161*e*4 and the first mode switching hole 161*e*5 may be opened and closed in connection with the first back pressure passage (BF1) or the second back pressure passage (BF2).

The suction pressure hole 161*e*4 may pass from an outer circumferential surface of the back pressure plate 161 to a side surface of the second valve receiving groove 161*d*, and the first mode switching hole 161*e*5 may pass from a bottom surface of the second valve receiving groove 161*d* to a bottom surface of the back pressure plate 161. The suction pressure hole 161*e*4 and the first mode switching hole 161*e*5 may have a same length in a longitudinal direction of the second valve receiving groove 161*d*.

The second mode switching hole 161*e*6 may be formed on or at one or a first side of the first mode switching hole 161*e*5, and the first mode switching hole 161*e*5 and the second mode switching hole 161*e*6 may communicate via the second extension groove 161*f*2. The second mode switching hole 161*e*6 may pass from a bottom surface of the back pressure plate 161 to an outer circumferential surface of the back pressure plate 161, The second mode switching hole 161e6 may communicate with the differential pressure hole 181c which will be described hereinafter.

The first mode switching hole 161e5 may be formed outside the second back pressure hole 161e2, Further, the first mode switching hole 161e5 may be formed radially on a straight line together with the first back pressure hole 161e1 and the second back pressure hole 161e2.

As described above, the back pressure control valve (hereinafter, "first control valve") 170 may be inserted and coupled to the second valve receiving groove 161d in a radial direction. For example, the first control valve 170 may be press-fitted and fixed to the second valve receiving groove 161d. Alternatively, the first control valve 170 may be fixed using a fixing pin (not shown).

Figure 7:
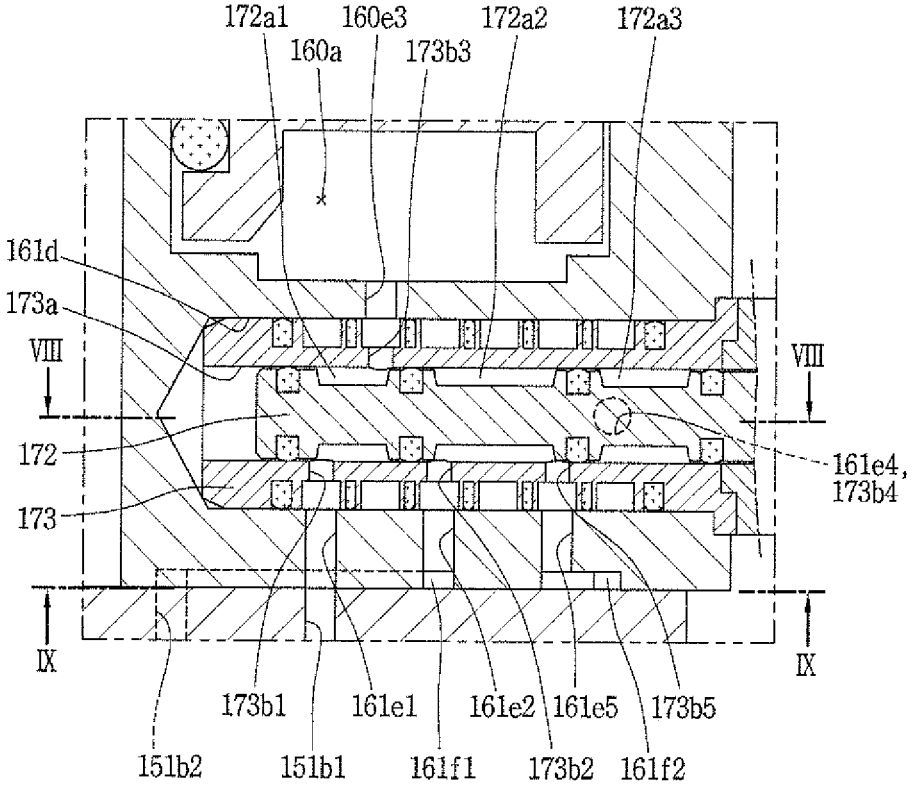
FIG. 7 is a cross-sectional view for explaining a back pressure control valve according to an embodiment.
Figure 8:
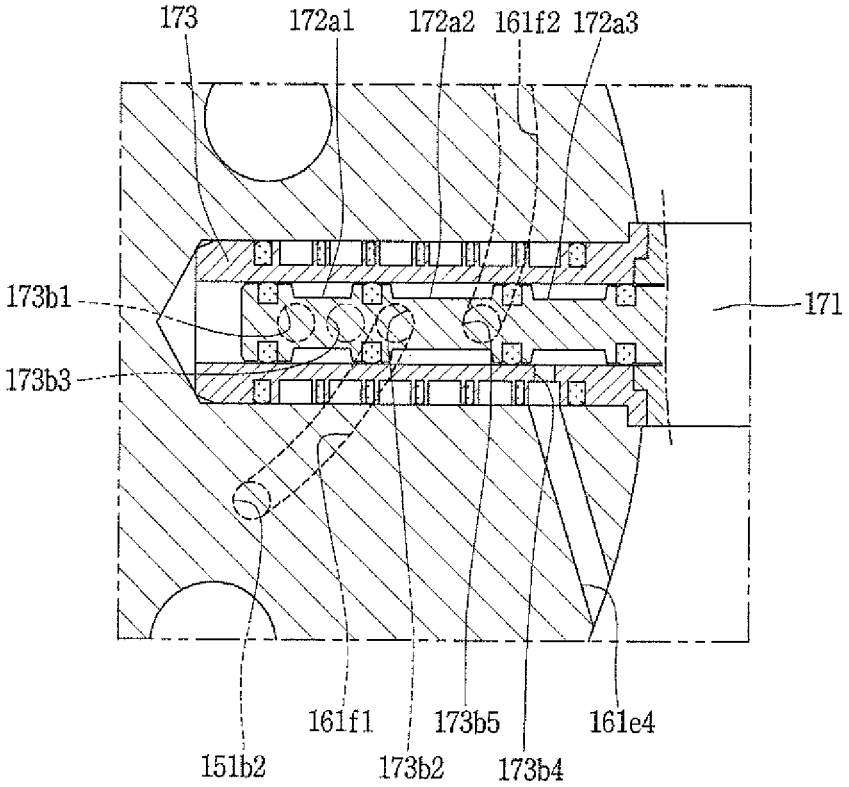
FIG. 8 is a cross-sectional view, taken along line "VIII-VIII" in FIG. 7.
Figure 9:
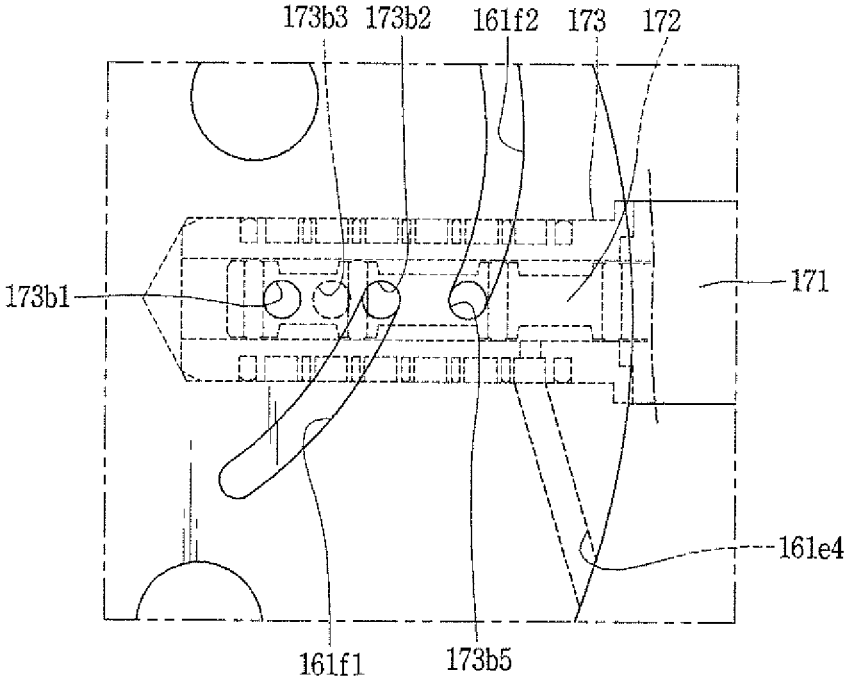
FIG. 9 is a cross-sectional view, taken along line "IX-IX" in FIG. 7.

FIG. 7 is a cross-sectional view for explaining a back pressure control valve according to an embodiment. FIG. 8 is a cross-sectional view, taken along line "VIII-VIII" in FIG. 7. FIG. 9 is a cross-sectional view, taken along line "IX-IX" in FIG. 7.

Referring again to FIG. 6, the first control valve 170 may include a power supply unit or power supply 171, a valve portion or valve 172, and a passage guide portion or guide 173. The power supply unit 171 may be provided with a mover (not shown) inside a coil (not shown) to which power may be supplied from an external power source, and a return spring (not shown) may be provided at one end of the mover. The valve 172 may be coupled to the other or a second end of the mover. The valve 172 may allow a first connecting hole 173b1 to communicate with a third connecting hole 173b3 or allows a second connecting hole 173b2 to communicate with the third connecting hole 173b3 in the passage guide 173 which will be described hereinafter.

The valve 172 may be connected to the mover of the power supply unit 171 to selectively open and close the first back pressure passage (BF1) or the second back pressure passage (BF2) while moving between a first position (P1) and a second position (P2). The first position (P1) may be a position at which the first back pressure passage (BF1) is opened and the second back pressure passage (BF2) is closed, and the second position (P2) may be a position at which the first back pressure passage (BF1) is closed and the second back pressure passage (BF2) is open.

Referring to FIGS. 7 through 9, the valve 172 may be formed in a circular rod shape, and a first connecting groove 172a1, a second connecting groove 172a2, and a third connecting groove 172a3 may be formed in order on an outer circumferential surface thereof. O-rings (not shown) that seat the respective connecting grooves may be inserted into both sides of the first connecting groove 172a1, both sides of the second connecting groove 172a2, and both sides of the third connecting groove 172a3.

When the valve 172 moves to the first position (P1), the first back pressure hole 161e1 and the third back pressure hole 161e3 may communicate via the first connecting groove 172a1, and the second back pressure hole 161e2 and the first mode switching hole 161e5 may communicate via the third connecting groove 172a3. In contrast, when the valve 172 moves to the second position (P2), the second back pressure hole 161e2 and the third back pressure hole 161e3 may communicate via second connecting groove 172a2, and the suction pressure hole 161e4 and the first mode switching hole 161e5 may communicate via the third connecting groove 172a3.

Referring to FIGS. 7 through 9, the passage guide 173 may be formed in a cylindrical shape, and a first valve receiving space 173a into which the valve 172 may be slidably inserted may be formed therein. The first valve receiving space 173a may be formed in the shape of a sleek smooth tube at an inner circumferential surface thereof.

A first connecting hole 173b1 and a second connecting hole 173b2 may be formed at a preset or predetermined interval in a longitudinal direction (radial direction) of the passage guide 173, and a third connecting hole 173b3 may be formed between the first connecting hole 173b1 and the second connecting hole 173b2. The first connecting hole 173b1 may communicate with the first back pressure hole 161e1, and the second connecting hole 173b2 may communicate with the second back pressure hole 161e2, and the third connecting hole 173b3 may communicate with the third back pressure hole 161e3.

Sealing may be carried out between the first connecting hole 173b1 and the third connecting hole 173b3 and between the third connecting hole 173b3 and the second connecting hole 173b2, respectively, and sealing may also be carried out on an outside of the first connection hole 173b1 and an outside of the second connection hole 173b2. Accordingly, the first connecting hole 173b1 and the third connecting hole 173b3 may communicate through the first connecting groove 172a1 when the valve 172 reaches the first position (P1), and closed when the valve 172 reaches the second position (P2). The second connecting hole 173b2 and the third connecting hole 173b3 may communicate through the first connecting groove 172a1 when the valve 172 reaches the second position (P2), and closed when the valve 172 reaches the first position (P1).

In addition, a fourth connecting hole 173b4 and a fifth connecting hole 173b5 may be formed at a preset or predetermined interval in the passage guide 173. The fourth connecting hole 173b4 may communicate with the suction pressure hole 161e4, and the fifth connecting hole 173b5 may communicate with the first mode switching hole 161e5.

The fourth connecting hole 173b4 may be sealed with the second connecting hole 173b2 and sealed outside the fifth connecting hole 173b5. Accordingly, the fourth connecting hole 173b4 and the fifth connecting hole 173b5 may communicate when the valve 172 reaches the first position (P1), and may be closed when the valve 172 reaches the second position (P2).

The capacity control valve 180 according to an embodiment may be provided on an outer circumferential surface of the back pressure plate 161. However, alternatively, the capacity control valve 180 may be provided on an outer circumferential surface of the non-orbiting scroll 150. However, this embodiment is advantageous in that the back pressure control valve 170 is formed on the back pressure plate 161 in a structured manner, and thus, an example in which the capacity control valve 180 is also provided in the back pressure plate 161 will mainly be described.

The capacity control valve 180 according to this embodiment may include a valve housing 181 and a piston valve 182. Referring again to FIGS. 5 and 6, the valve housing 181 may be formed with a second valve receiving space 181a therein, and a differential pressure space 181b may be formed on or at a rear side of the second valve receiving space 181a, and the differential pressure space 181b may communicate with a differential pressure hole 181c provided on or at one or a first side of the second valve receiving space 181a.

The differential pressure hole 181c may communicate with the second mode switching hole 161e6. Therefore, the differential pressure hole 181c may communicate with the second intermediate pressure hole 151b2 or the suction pressure hole 161e4 through the second extension groove 161f2 and the first mode switching hole 161e5. Accordingly, refrigerant at a second intermediate pressure may flow into the differential pressure space 181*b* when the piston valve 182 of the back pressure control valve 180 reaches the first position (P1), and refrigerant at a suction pressure when the piston valve 182 reaches the second position (P2).

Further, a discharge groove 181*d* that communicates the second valve receiving space 181*a* with the suction space 111 of the casing 110 may be formed on or at one or a first side of the valve housing 181. The discharge groove 181*d* may selectively communicate with or be closed along with the discharge hole 161*c* by the piston valve 182.

The piston valve 182 may be slidably inserted into the second valve receiving space 181*a* to move between a third position (P3) and a fourth position (P4) according to a pressure difference of the differential pressure space 181*b* formed on the back pressure surface. The third position (P3) may be a position at which the piston valve 172 blocks communication between the discharge hole 161*c* and the discharge groove 181*d*, and the fourth position (P4) may be a position at which the piston valve 182 opens or provides communication between the discharge hole 161*c* and the discharge grooves 181*d*.

A support spring 183 may be provided on a back surface of the piston valve 182 to elastically support the piston valve 182 so as to be quickly closed.

Figure 10A:
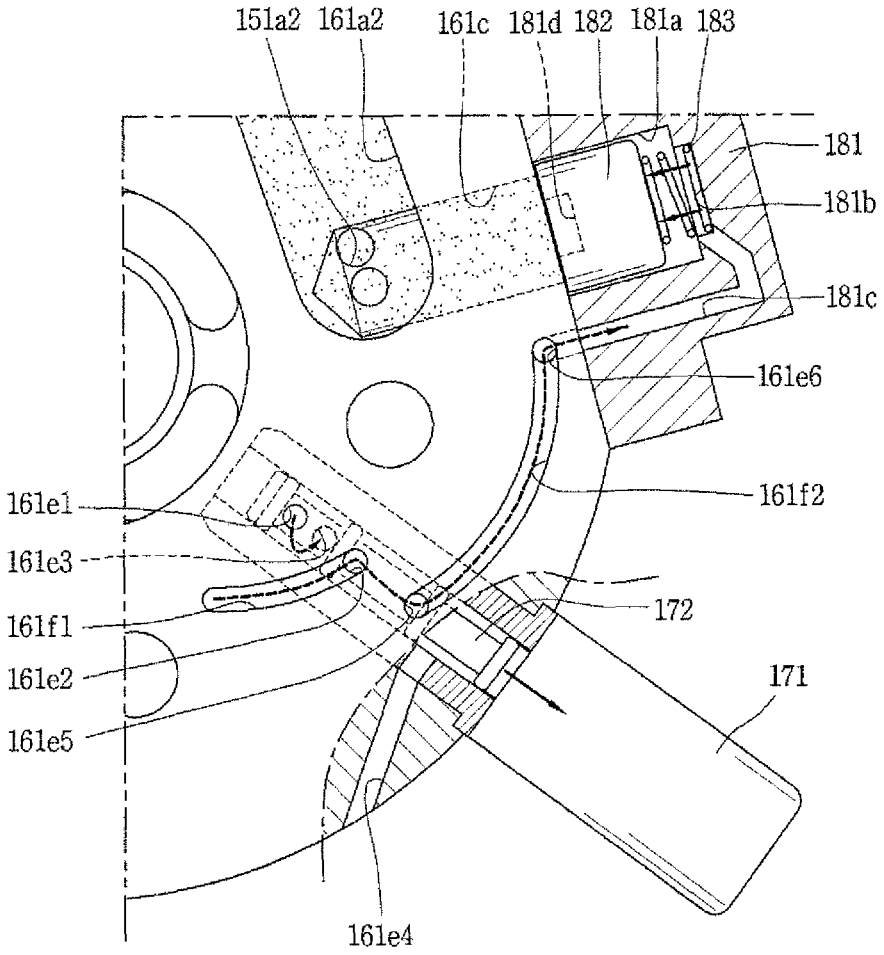
FIGS. 10A-10B and 11A-11B are plan views and cross-sectional views for explaining a process of varying discharge pressure according to an operation mode of a compressor in a scroll compressor according to an embodiment.
Figure 10B:
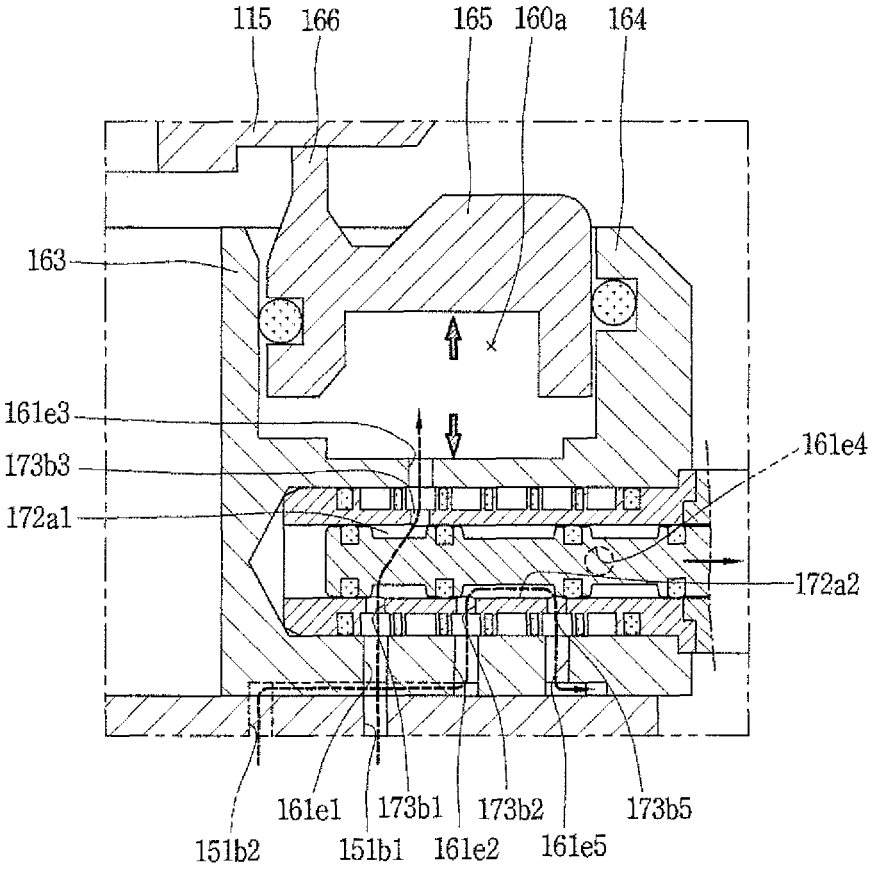
Figure 11A:
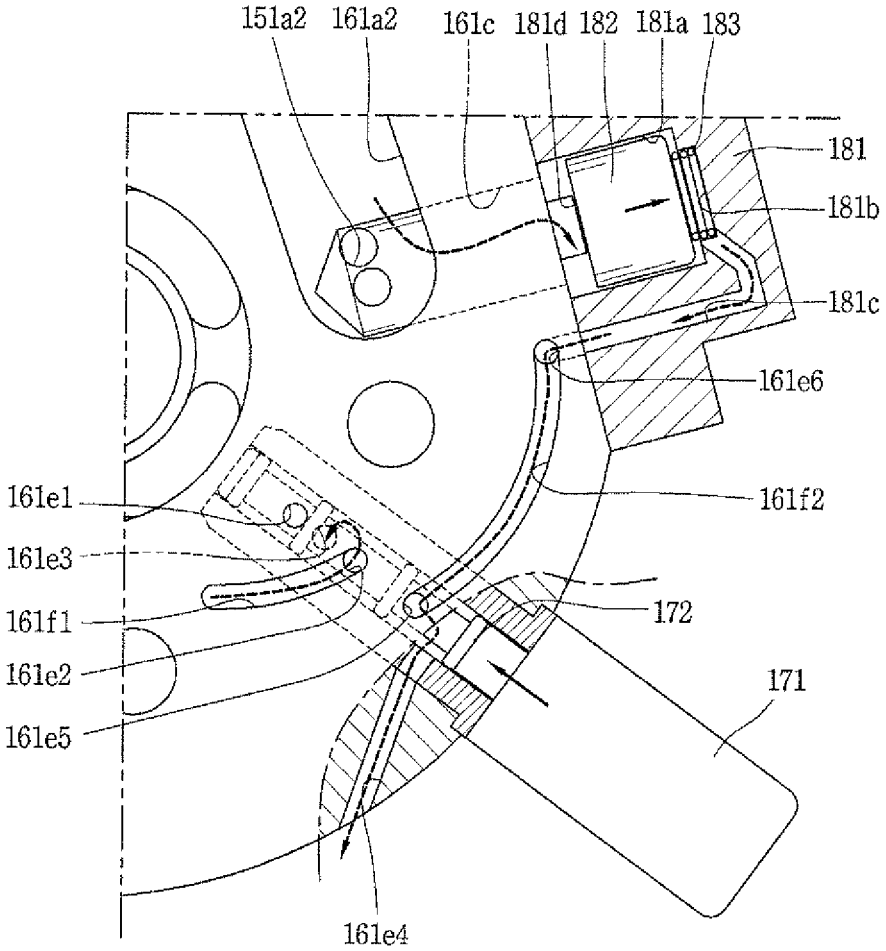
Figure 11B:
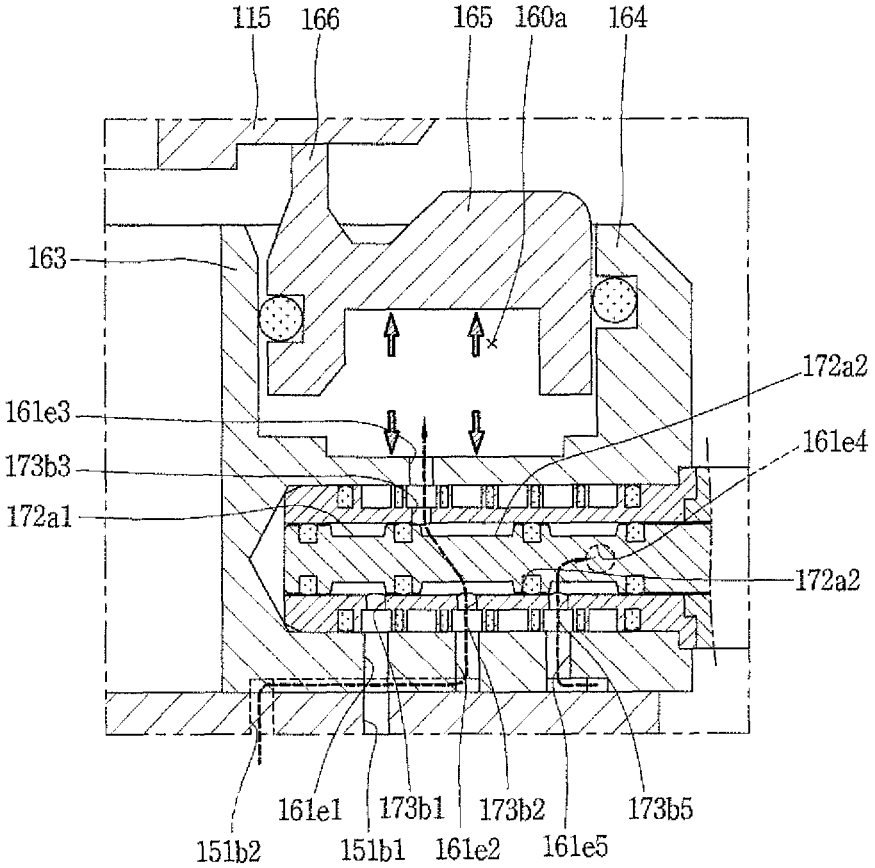

FIGS. 10A and 11B are a plan view and a cross-sectional view for explaining a process of varying discharge pressure according to an operation mode of a compressor in a scroll compressor according to embodiments. FIGS. 10A and 10B are views showing a power operation, and FIGS. 11A and 11B are views showing a saving operation.

Referring to FIGS. 10A and 10B, power may be applied to the first control valve 170 when the cooling system is operated in a power mode. Then, the valve 172 may be moved to the first position (P1) by the power supply unit 171.

Then, the third connecting hole 173*b*3 may communicate with the first connecting hole 173*b*1 via the first connecting groove 172*a*1 while the fifth connecting hole 173*b*5 may communicate with the second connecting hole 173*b*1 via the second connecting groove 172*a*2. In other words, refrigerant in the first intermediate pressure chamber (V1) may sequentially pass through the first intermediate pressure hole 151*b*1, the first back pressure hole 161*e*1, and the first connecting hole 173*b*1, and then may be guided to the third connecting hole 173*b*3 through the first connecting groove 172*a*1, and the refrigerant may be moved to the back pressure chamber 160*a* through the third back pressure hole 161*e*3.

Refrigerant in the second intermediate pressure chamber (V2) may sequentially pass through the second intermediate pressure hole 151*b*2, the second back pressure hole 161*e*2, and the second connecting hole 173*b*2, and then may be guided to the fifth connecting hole 173*b*5 through the second connecting groove 172*a*2, and refrigerant may be moved to the differential pressure space 181*b* of the second control valve 180 through the first mode switching hole 161*e*5, the second extension groove 161*f*2, the second mode switching hole 161*e*6, and the differential pressure hole 181*c*. Then, the piston valve 182 forming the second control valve 180 may move to the third position (P3) while being pushed by high back pressure at a second intermediate pressure to block communication between the discharge hole 161*c* and the discharge groove 181*d*. Then, the compressor may perform a power operation while blocking the capacity variable bypass hole 151*a*.

As the refrigerant of the first intermediate pressure chamber (V1) flows into the back pressure chamber 160*a* as described above, an internal pressure of the back pressure chamber 160*a* may form a first back pressure which is the pressure of the first intermediate pressure chamber (V1). As the pressure of the first intermediate pressure chamber (V1) is lower than the pressure of the second intermediate pressure chamber (V2) which is the second back pressure, the first back pressure may be lower than the second back pressure. Therefore, it may be possible to prevent friction loss or wear between the scrolls which may occur when the back pressure is high during the power operation.

In contrast, referring to FIGS. 11A and 11B, power may be removed from the power supply unit 171 of the first control valve 170 when the cooling system operates in a saving mode. Then, the valve 172 may be moved to the second position (P2) by the return spring. Then, the second connection hole 173*b*2 and the third connection hole 173*b*3 of the passage guide 173 may communicate via the second connecting groove 172*a*2 of the valve 172.

Then, refrigerant may sequentially pass through the second intermediate pressure hole 151*b*2, the second back pressure hole 161*e*2, and the second connecting hole 173*b*2 in the second intermediate pressure chamber, and then may be guided to the third connecting hole 173*b*3 through the second connecting groove 172*a*2. The refrigerant may move to the back pressure chamber 160*a* through the third back pressure hole 161*e*3 such that an internal pressure of the back pressure chamber 160*a* may form a second back pressure.

As the valve 172 moves to the second position (P2), the fourth connecting hole 173*b*4 may communicate with the fifth connecting hole 173*b*5 via the third connecting groove 172*a*3. Then, refrigerant filled in the suction space 111 of the casing 110 may pass through the suction pressure hole 161*e*4 and the fourth connecting hole 173*b*4, and then may be guided to the fifth connecting hole 173*b*5, and the refrigerant may move to the differential pressure space 181*b* of the second control valve 180 through the first mode switching hole 161*e*5, the second extension groove 161*f*2, the second mode switching hole 161*e*6, and the differential pressure hole 181*c*. Then, a back pressure of the piston valve 182 forming the second control valve 180 may form a suction pressure, and thus, the piston valve 182 may open passage between the discharge hole 161*c* and the discharge groove 181*d* while being pushed against the pressure of the intermediate pressure space including the discharge hole 161*c* to move to the fourth position (P4). Then, the compressor may perform a saving operation while the capacity variable bypass hole 151*b* opens to bypass refrigerant filled in the intermediate pressure space into the suction space 111 of the casing 110.

As the refrigerant of the first intermediate pressure chamber (V2) flows into the back pressure chamber 160*a* as described above, the internal pressure of the back pressure chamber 160*a* forms a second back pressure. As the second back pressure forms a pressure higher than the first back pressure, it may be possible to prevent compression loss due to spacing between the scrolls which may occur when the back pressure is low during the saving operation.

The respective components for the check valve, the back pressure control valve, and the capacity control valve according to embodiments may be formed on a bottom surface of the back pressure plate or inside the back pressure plate, but in some cases, may also be formed on an upper surface of the non-orbiting scroll or inside the non-orbiting scroll. A shape and size of these components and resultant operational effects may be formed similarly to the foregoing embodiment. Accordingly, detailed description thereof has been omitted. However, when the components for varying the capacity, particularly, the first valve receiving groove, the communication groove, and the discharge hole are formed on a back surface of the non-orbiting end plate as in this embodiment, a length of the bypass hole and the back pressure hole decreases to reduce dead volume accordingly.

Embodiments disclosed herein provide a scroll compressor capable of lowering a capacity variation ratio of the compressor to increase a system efficiency of a refrigeration device to which the compressor is applied. Embodiments disclosed herein also provide a scroll compressor capable of suppressing an increase in friction loss during power operation while reducing a capacity variable ratio of the compressor and preventing leakage of refrigerant during a saving operation to increase compressor efficiency.

Embodiments disclosed herein further provide a scroll compressor capable of forming pressure in a back pressure chamber using a plurality of intermediate pressures. Additionally, embodiments disclosed herein provide a scroll compressor capable of simplifying the structure of the capacity variable device to reduce the number of components, thereby reducing manufacturing costs.

Embodiments disclosed herein provide a scroll compressor capable of strengthening sealing structure during assembly of the capacity variable device to increase reliability. Also, embodiments disclosed herein provide a scroll compressor capable of increasing assemblability of the capacity variable device, thereby reducing manufacturing costs and increasing assembly reliability.

Embodiments disclosed herein provide a scroll compressor in which a pair of compression chambers may be formed by a pair of scrolls, and a back pressure chamber may be formed on a rear surface of either one of the scrolls to communicate with the compression chambers. A plurality of back pressure holes that communicate with the back pressure chamber may be provided, the plurality of back pressure holes may be formed at regular intervals, and the plurality of back pressure holes may be independently opened and closed by one valve to control a pressure of the back pressure chamber. The plurality of back pressure holes may communicate with a plurality of intermediate pressure chambers having different intermediate pressures between a suction pressure and a discharge pressure.

In addition, a back pressure control valve that selectively opens and closes a plurality of back pressure holes according to an operation mode may be provided between the plurality of intermediate pressure chambers and the back pressure chamber. The back pressure control valve may provide communication between an intermediate pressure chamber having a low pressure among the plurality of intermediate pressure chambers and the back pressure chamber in a power operation, and communication between an intermediate pressure chamber having a high pressure among the plurality of intermediate pressure chambers and the back pressure chamber in a saving operation.

One or a first end of the plurality of back pressure holes may communicate with the plurality of intermediate pressure chambers, respectively, and the other or a second end of the plurality of back pressure holes may be joined to communicate with the back pressure chamber. Further, the plurality of back pressure holes may be formed to be located in a straight line in a radial direction.

Embodiments disclosed herein further provide a scroll compressor that may include a casing in which a sealed inner space is divided into a suction space and a discharge space; an orbiting scroll that performs an orbiting movement in the inner space of the casing; a non-orbiting scroll engaged with the orbiting scroll to form a compression chamber including a suction chamber, an intermediate pressure chamber, and a discharge chamber between the orbiting scroll and the non-orbiting scroll; a back pressure chamber assembly coupled to the non-orbiting scroll to form a back pressure chamber so as to support the non-orbiting scroll toward the orbiting scroll; a first back pressure passage that connects a first intermediate pressure chamber and the back pressure chamber in the compression chamber; a second back pressure passage that connects a second intermediate pressure chamber having a higher pressure than the first intermediate pressure chamber and the back pressure chamber; and a back pressure control valve configured to selectively open and close the first back pressure passage and the second back pressure passage according to an operation mode. The back pressure control valve may move to a first position at which the first back pressure passage is open and the second back pressure passage may be closed in a power operation, and move to a second position at which the first back pressure passage is closed and the second back pressure passage is open in a saving operation.

One or a first end of the first back pressure passage may communicate with the first intermediate pressure chamber, and one or a first end of the second back pressure passage may be spaced apart from the first back pressure passage by a preset or predetermined distance to communicate with the second intermediate pressure chamber, and the other or a second end of the first back pressure passage and the other or a second end of the second back pressure passage may be joined to communicate with the back pressure chamber.

The first back pressure passage may include a first back pressure hole that communicates with the first intermediate pressure chamber, and the second back pressure passage may include a second back pressure hole that communicates with the second intermediate pressure chamber. The first back pressure hole and the second back pressure hole may be formed to be located in a straight line in a radial direction.

The scroll compressor may include a third back pressure hole at which the first back pressure passage and the second back pressure passage are joined to communicate with the back pressure chamber. The third back pressure hole may be formed to be located between the first back pressure hole and the second back pressure hole in a radial direction.

The non-orbiting scroll may be formed with a first intermediate pressure hole that provides communication between the first back pressure hole and the first intermediate pressure chamber and a second intermediate pressure hole that provides communication between the second back pressure hole and the second intermediate pressure chamber, respectively. The first intermediate pressure hole and the second intermediate pressure hole may be spaced apart from each other by a preset or predetermined distance in a circumferential direction. Either one of the first intermediate pressure hole or the second intermediate pressure hole may communicate with the relevant back pressure hole by a first extension groove extended in a circumferential direction.

A capacity variable bypass hole for bypassing refrigerant in the intermediate pressure chamber may be formed in the back pressure chamber assembly or the non-orbiting scroll, a discharge passage that communicates with the capacity variable bypass hole to discharge the bypassed refrigerant to an internal space of the casing may be formed in the back pressure chamber assembly or the non-orbiting scroll, and a capacity control valve that selectively opens and closes the discharge passage while being operated in connection with the back pressure control valve may be provided in the back pressure chamber assembly or the non-orbiting scroll. The capacity control valve may include a valve housing coupled to the back pressure chamber assembly or the non-orbiting scroll; and a valve member slidably inserted into the valve housing to selectively open and close the discharge passage. The valve housing may be formed with a differential pressure space for providing a suction pressure or an intermediate pressure to the valve member, and the differential pressure space may communicate with the intermediate pressure chamber or the suction space of the casing through a differential pressure hole provided in the valve housing. The intermediate pressure chamber that communicates with the differential pressure space may be an intermediate pressure chamber that communicates with the second back pressure passage.

A valve receiving groove to which the back pressure control valve may be coupled may be formed in the back pressure chamber assembly or the non-orbiting scroll. The valve receiving groove may communicate with a suction pressure hole that communicates with the suction space of the casing and a mode switching hole that communicates with the differential pressure space. The suction pressure hole and the mode switching hole may be selectively connected or disconnected by the back pressure control valve.

The back pressure control valve and the capacity control valve may be spaced apart by a preset or predetermined distance in a circumferential direction. The mode switching hole and the differential pressure hole may be connected by a second extension groove extended in a circumferential direction.

The back pressure control valve may include a power supply unit: and a valve portion or valve that moves between the first position and the second position by power supplied to the power supply unit.

The scroll compressor may further include a passage guide portion or guide inserted and fixed to the back pressure chamber assembly or the non-orbiting scroll, into which the valve portion may be slidably inserted, to form the first back pressure passage and the second back pressure passage together with the valve portion. The passage guide portion may be formed with a first connecting hole forming the first back pressure passage, a second connecting hole forming the second back pressure passage, a third connecting hole that communicates with the back pressure chamber, a fourth connecting hole that communicates with the suction pressure hole, and a fifth connecting hole that communicates with the mode switching hole. A first connecting groove that provides communication between the first connecting hole and the third connecting hole, a second connecting groove that provides communication between the second connecting hole and the third connecting hole, and a third connecting groove that provides selectively communication between the second connecting hole or the fourth connecting hole and the fifth connecting hole may be formed at preset or predetermined intervals along a longitudinal direction in the valve portion. A sealing member may be provided between the respective connecting grooves.

A plurality of back pressure passages that communicates with different back pressure chambers may selectively communicate with a back pressure chamber according to a capacity variation of the compressor, thereby preventing efficiency from being reduced in advance due to capacity variation as well as greatly reducing a capacity variation ratio of the compressor. Moreover, a back pressure may be differently controlled according to the operation mode of the compressor to prevent refrigerant leakage during a saving operation while at the same time reducing a friction loss during a power operation, thereby increasing compressor efficiency and enhancing efficiency of a system to which the compressor is applied.

Further, a capacity control valve for controlling an operation mode of the compressor and a back pressure control valve for operating the capacity control valve may be provided in an inner space of the casing to greatly reduce the number of parts or components for interlocking a plurality of control valves, thereby reducing manufacturing costs. Moreover, a passage for capacity control and back pressure control of the compressor may be formed inside of a back pressure chamber assembly or non-orbiting scroll to simplify assembly structure as well as strengthening a sealing structure, thereby enhancing reliability. Also, the capacity control valve and the back pressure control valve may be respectively modularized to enhance assemblability of the capacity control valve and the back pressure control valve, thereby reducing manufacturing costs and increasing assembly reliability.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a casing in which a sealed inner space is divided into a suction space and a discharge space;

an orbiting scroll that performs an orbiting movement in the inner space of the casing;

a non-orbiting scroll engaged with the orbiting scroll to form a pair of compression chambers between the orbiting scroll and the non-orbiting scroll;

a back pressure chamber assembly coupled to the non-orbiting scroll to form a back pressure chamber so as to support the non-orbiting scroll toward the orbiting scroll;

a first back pressure passage that connects a first intermediate pressure chamber in the pair of compression chambers and the back pressure chamber;

a second back pressure passage that connects a second intermediate pressure chamber in the pair of compression chambers and the back pressure chamber, the second intermediate pressure chamber having a higher pressure than the first intermediate pressure chamber; and a back pressure control valve configured to selectively open and close the first back pressure passage and the second back pressure passage according to an operation mode, wherein the back pressure control valve moves to a first position at which the first back pressure passage is open and the second back pressure passage is closed in a power operation, and moves to a second position at which the first back pressure passage is closed and the second back pressure passage is open in a saving operation, wherein a capacity variable bypass hole that bypasses refrigerant in the intermediate pressure chambers is formed in the back pressure chamber assembly or the non-orbiting scroll, wherein a discharge passage that communicates with the capacity variable bypass hole to discharge the bypassed refrigerant to the inner space of the casing is formed in the back pressure chamber assembly or the non-orbiting scroll, and wherein a capacity control valve that selectively opens and closes the discharge passage while being operated in connection with the back pressure control valve is provided in the back pressure chamber assembly or the non-orbiting scroll.

2. The scroll compressor of claim 1, wherein a first end of the first back pressure passage communicates with the first intermediate pressure chamber, wherein a first end of the second back pressure passage is spaced apart from the first back pressure passage by a predetermined distance to communicate with the second intermediate pressure chamber, and wherein a second end of the first back pressure passage and a second end of the second back pressure passage are joined to communicate with the back pressure chamber.

3. The scroll compressor of claim 2, wherein the first back pressure passage comprises a first back pressure hole that communicates with the first intermediate pressure chamber, wherein the second back pressure passage comprises a second back pressure hole that communicates with the second intermediate pressure chamber, and wherein the first back pressure hole and the second back pressure hole are located on a straight line in a radial direction of the scroll compressor.

4. The scroll compressor of claim 3, comprising:

a third back pressure hole by which the first back pressure passage and the second back pressure passage are joined to communicate with the back pressure chamber, wherein the third back pressure hole is located between the first back pressure hole and the second back pressure hole in the radial direction of the scroll compressor.

5. The scroll compressor of claim 4, wherein the non-orbiting scroll includes a first intermediate pressure hole that provides communication between the first back pressure hole and the first intermediate pressure chamber and a second intermediate pressure hole that provides communication between the second back pressure hole and the second intermediate pressure chamber, respectively, and wherein the first intermediate pressure hole and the second intermediate pressure hole are spaced apart from each other by a predetermined distance in a circumferential direction of the scroll compressor.

6. The scroll compressor of claim 5, wherein either one of the first intermediate pressure hole or the second intermediate pressure hole communicates with the relevant back pressure hole by a first extension groove that extends in the circumferential direction of the scroll compressor.

7. The scroll compressor of claim 1, wherein the capacity control valve comprises:

a valve housing coupled to the back pressure chamber assembly or the non-orbiting scroll; and a valve slidably inserted into the valve housing to selectively open and close the discharge passage, wherein the valve housing is formed with a differential pressure space to provide a suction pressure or an intermediate pressure to the valve, and wherein the differential pressure space communicates with the intermediate pressure chamber or the suction space of the casing through a differential pressure hole provided in the valve housing.

8. The scroll compressor of claim 7, wherein the intermediate pressure chamber communicating with the differential pressure space is the intermediate pressure chamber communicating with the second back pressure passage.

9. The scroll compressor of claim 1, wherein a valve receiving groove to which the back pressure control valve is coupled is formed in the back pressure chamber assembly or the non-orbiting scroll, wherein the valve receiving groove communicates with a suction pressure hole that communicates with the suction space of the casing and a mode switching hole that communicates with the differential pressure space, and wherein the suction pressure hole and the mode switching hole are selectively connected or disconnected by the back pressure control valve.

10. The scroll compressor of claim 9, wherein the back pressure control valve and the capacity control valve are spaced apart by a predetermined distance in a circumferential direction of the scroll compressor, and wherein the mode switching hole and the differential pressure hole are connected by a second extension groove that extends in the circumferential direction of the scroll compressor.

11. The scroll compressor of claim 10, wherein the back pressure control valve comprises:

a power supply unit; and a valve that is moved between the first position and the second position by power supplied to the power supply unit.

12. The scroll compressor of claim 11, further comprising:

a passage guide inserted and fixed to the back pressure chamber assembly or the non-orbiting scroll, into which the valve is slidably inserted, to form the first back pressure passage and the second back pressure passage together with the valve, wherein the passage guide includes a first connecting hole forming the first back pressure passage, a second connecting hole forming the second back pressure passage, a third connecting hole that communicates with the back pressure chamber, a fourth connecting hole that communicates with the suction pressure hole, and a fifth connecting hole that communicates with the mode switching hole.

13. The scroll compressor of claim 12, wherein a first connecting groove that provides communication between the first connecting hole and the third connecting hole, a second connecting groove that provides communication between the second connecting hole and the third connecting hole, and a third connecting groove that selectively provides communication between the second connecting hole or the fourth connecting hole and the fifth connecting hole are formed at predetermined intervals along a longitudinal direction in the valve, and wherein a sealing member is provided between the respective connecting grooves.

14. The scroll compressor in which a pair of compression chambers is formed by a pair of scrolls, and a back pressure chamber communicates with the pair of compression chambers and is formed on a back surface of one of the pair of scrolls, the scroll compressor comprising:

a plurality of back pressure holes that provides communication with the back pressure chamber, wherein the plurality of back pressure holes is formed at regular intervals, and the plurality of back pressure holes is independently opened and closed by a single valve to control a pressure of the back pressure chamber, and wherein the plurality of back pressure holes is located on a straight line in a radial direction of the scroll compressor.

15. The scroll compressor of claim 14, wherein the plurality of back pressure holes communicates with a plurality of intermediate pressure chambers having different intermediate pressures between a suction pressure and a discharge pressure.

16. The scroll compressor of claim 15, wherein the valve is provided between the plurality of intermediate pressure chambers and the back pressure chamber and selectively opens and closes the plurality of back pressure holes according to an operation mode, wherein the valve provides communication between an intermediate pressure chamber having a relatively low pressure among the plurality of intermediate pressure chambers and the back pressure chamber in a power operation mode, and provides communication between an intermediate pressure chamber having a relatively high pressure among the plurality of intermediate pressure chambers and the back pressure chamber during a saving operation.

17. The scroll compressor of claim 16, wherein first ends of the plurality of back pressure holes communicate with the plurality of intermediate pressure chambers, respectively, and second ends of the plurality of back pressure holes are joined to communicate with the back pressure chamber.

18. A scroll compressor, comprising:

a casing in which a sealed inner space is divided into a suction space and a discharge space;

an orbiting scroll that performs an orbiting movement in the inner space of the casing;

a non-orbiting scroll engaged with the orbiting scroll to form a pair of compression chambers between the orbiting scroll and the non-orbiting scroll;

a back pressure chamber assembly coupled to the non-orbiting scroll to form a back pressure chamber so as to support the non-orbiting scroll toward the orbiting scroll;

a plurality of back pressure passages that connects intermediate pressure chambers in the pair of compression chambers and the back pressure chamber, the intermediate pressure chambers having different intermediate pressures between a suction pressure and a discharge pressure; and a back pressure control valve configured to selectively open and close the plurality of back pressure passages according to one of a plurality of operation modes including a power operation and a saving operation, wherein first ends of the plurality of back pressure passages communicate with the different intermediate pressure chambers, and second ends of the plurality of back pressure passages are joined to communicate with the back pressure chamber, and wherein the plurality of back pressure passages is located on a straight line in a radial direction of the scroll compressor.

* * * * *